US008166706B2

(12) United States Patent
Slimak et al.

(10) Patent No.: US 8,166,706 B2
(45) Date of Patent: May 1, 2012

(54) MULTIPOSITIONAL VAULT DOOR

(75) Inventors: Louis Slimak, Pembroke Pines, FL (US); Marvin Lopez, Miami, FL (US)

(73) Assignee: U.S.F. Fabrication, Inc., Hialeah, FL (US)

( * ) Notice: Subject to any disclaimer, the term of this patent is extended or adjusted under 35 U.S.C. 154(b) by 365 days.

(21) Appl. No.: 12/480,054

(22) Filed: Jun. 8, 2009

(65) Prior Publication Data

US 2010/0307060 A1 Dec. 9, 2010

(51) Int. Cl.
*E05F 1/10* (2006.01)

(52) U.S. Cl. ..... 49/386; 49/387; 49/388; 49/399; 49/400; 49/131; 16/357; 16/360; 16/361; 16/366

(58) Field of Classification Search ..... 49/388, 49/387, 386, 399, 400, 394; 16/357, 360, 16/361, 366, 368; 248/447, 449, 459, 155.2, 248/155.3

See application file for complete search history.

(56) References Cited

U.S. PATENT DOCUMENTS

| | | | | | |
|---|---|---|---|---|---|
| 20,679 | A * | 6/1858 | Brown | 49/394 |
| 195,965 | A * | 10/1877 | Straight | 49/56 |
| 2,249,403 | A * | 7/1941 | Stollsteimer | 248/240.3 |
| 4,133,074 | A | 1/1979 | Schack | |
| 4,163,344 | A * | 8/1979 | Scherer | 49/386 |
| 4,535,908 | A * | 8/1985 | Dabich | 220/484 |
| 5,029,362 | A * | 7/1991 | Prodan | 16/236 |
| 5,076,188 | A * | 12/1991 | Burroughs | 114/201 R |
| 5,205,073 | A * | 4/1993 | Lyons, Sr. | 49/386 |
| 5,324,135 | A * | 6/1994 | Smith | 404/25 |
| 6,041,553 | A * | 3/2000 | Joyce et al. | 49/504 |
| 6,718,692 | B2 * | 4/2004 | McKernan | 49/67 |

* cited by examiner

*Primary Examiner* — Jerry Redman
*Assistant Examiner* — Marcus Menezes
(74) *Attorney, Agent, or Firm* — GrayRobinson, P.A.; Michael J. Colitz, III

(57) ABSTRACT

The present invention relates to a vault door mechanism that assists a user in opening or closing the door. A hold-open arm and hinge plate pivotally interconnect the door to a surrounding frame and are fixed in place by an associated locking mechanism. The locking mechanism stops the door in the partially opened position prior to being fully opened or closed, thereby assisting the user in handling the door. The details of the present invention, and the manner in which they interrelate, will be described in greater detail hereinafter.

7 Claims, 5 Drawing Sheets

MULTIPOSITIONAL VAULT DOOR

FIELD OF THE INVENTION

This invention relates to vault door. More particularly, the present invention relates to a vault door that is selectively positionable between closed, partially opened, and fully opened orientations.

DESCRIPTION OF THE BACKGROUND ART

The use of access doors in known in the prior art. These doors are often mounted within the ground and control access to underground utilities. Access doors have to be strong enough to prevent unauthorized access as well as to withstand vehicle traffic. But access doors must also be light enough to permit opening by a single user. Access door must also be capable of opening wide enough to ingress of larger equipment.

An example of a prior art access door is disclosed in U.S. Pat. No. 4,133,074 to Schack. Schack discloses a spring assisted door construction. The door of Schack includes both closed, raised, and fully open positions. A first pair of torsion rods are arranged to be loaded when the door is swung down to a closed position from a raised position. A second pair of torsion bars are arranged to be stressed when the door is swung down to its fully open position from its raised position.

Although Schack addresses issues associated with the weight of the door via torsion bars, it nonetheless does not provide a door with discrete opened orientations. Nor does Schack otherwise relate to mechanism for locking an access door in one of two opened positions.

SUMMARY OF THE INVENTION

It is therefore one of the objectives of this invention to provide an access door with two discrete opened orientations.

It is also an object of this invention to provide an access door that must be brought to a partially opened orientation before being fully closed.

Still another object of this invention is to provide an access door that can be locked in a partially opened orientation.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a vault door mechanism that assists a user in opening or closing the door. A hold-open arm and hinge plate pivotally interconnect the door to a surrounding frame and are fixed in place by an associated locking mechanism. The locking mechanism stops the door in the partially opened position prior to being fully opened or closed, thereby assisting the user in handling the door. The details of the present invention, and the manner in which they interrelate, will be described in greater detail hereinafter.

Figure 1:
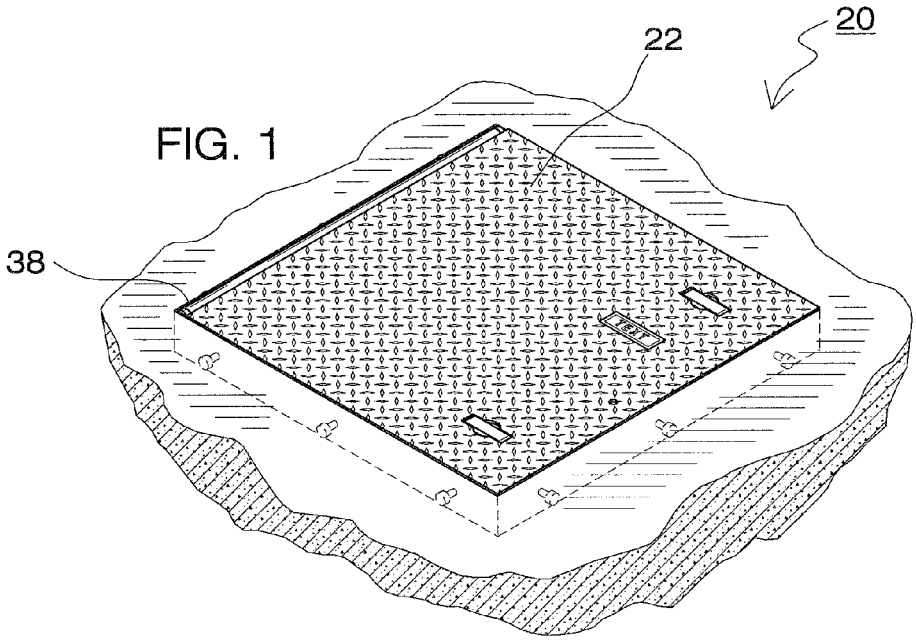
FIG. 1 is a perspective view of the vault door in the closed orientation.
Figure 2:
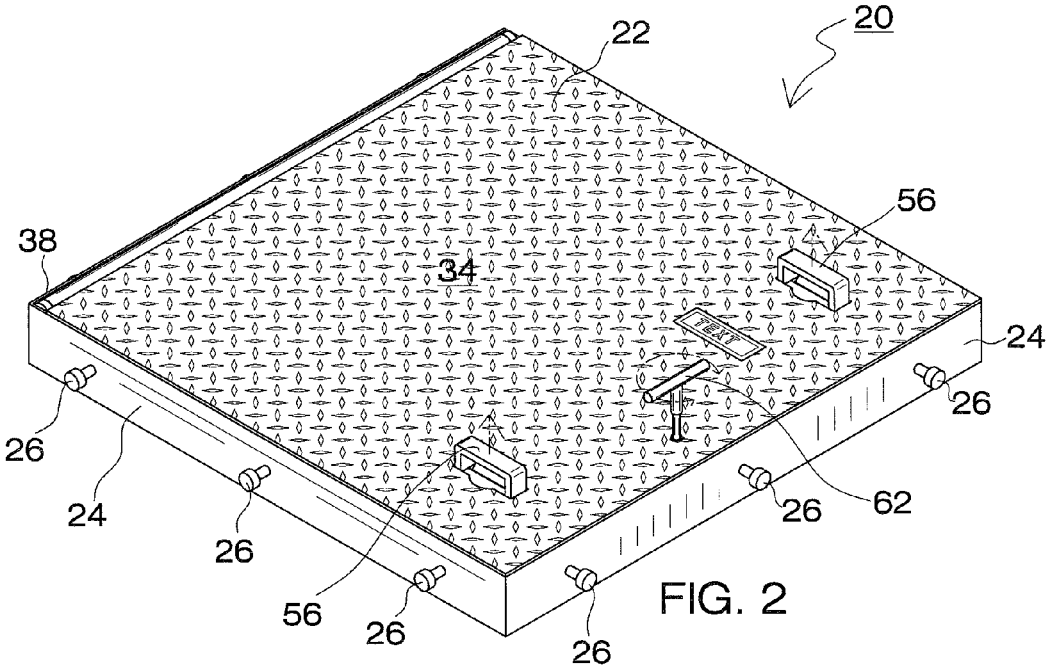
FIG. 2 is a perspective view of the vault door showing the peripheral edge.

With reference to FIGS. 1 and 2, the closure 20 of the present invention is depicted. Closure 20 comprises a vault door 22 and a surrounding frame 24. In the depicted embodiment, both frame 24 and door 22 have a rectangular shape, although those of ordinary skill in the art will readily appreciate other configurations. Frame 24 is defined by both inner and outer peripheral extents and is designed to be ground mounted so as to an access opening for an underground vault. For instance, frame 24 may define an opening to an underground utility. Frame 24 is preferably formed from steel that is hot dipped galvanized after fabrication.

Figure 4:
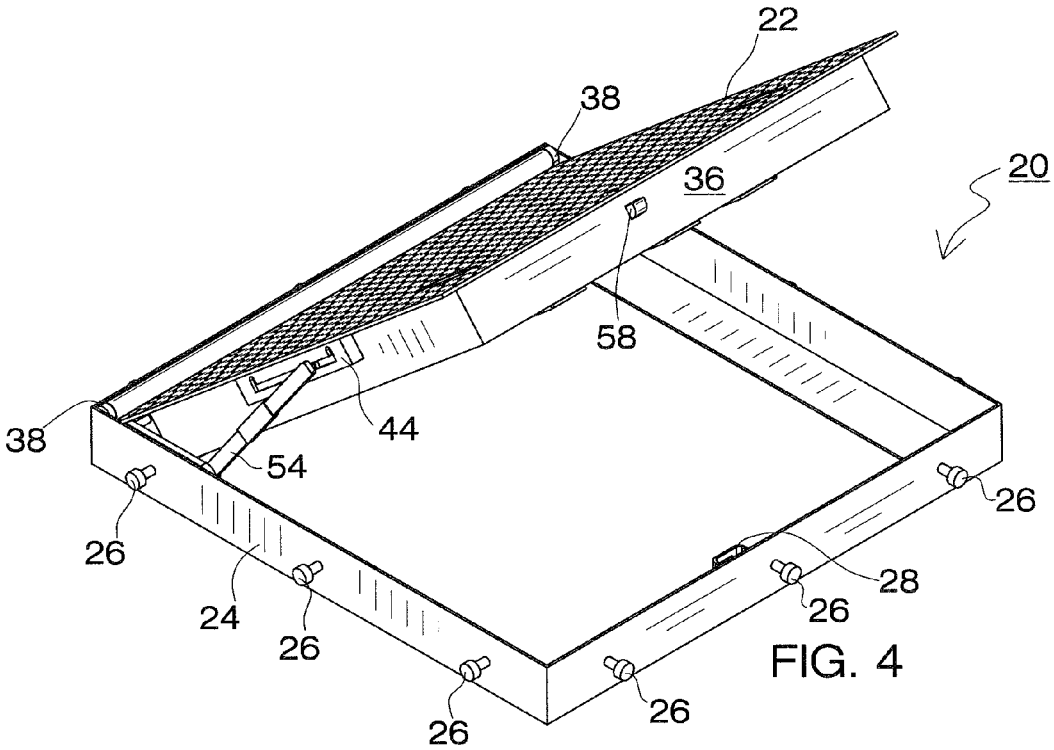
FIG. 4 is a perspective view of the vault door being opened.

A series of anchor studs 26 are positioned upon the outer peripheral extent of frame 24 and permit frame 24 to be set within a cementitious material such as concrete. With reference to FIG. 4, a female receiver 28 is preferably formed within frame 24 and cooperates with a corresponding locking element in door 22.

Vault door 22 includes interior and exterior surfaces (32 and 34) and depending peripheral edges 36. Door 22 is pivotally connected to the surrounding frame 24 via a conventional hinge assembly 38. Door 22 is preferably fabricated from aluminum diamond plate and comes with a mill finish. An optional anti-slip coating can also be supplied upon exterior surface 34. The interior surface 32 of door 22 includes a series reinforcing ribs 42 to strengthen the door leaf. Although the typical installation will be in off-street areas, the door 22 should ideally be strong enough to withstand occasional vehicle traffic. Thus, the door must be strong enough to withstand a 16,000 LB wheel load.

Figure 3:
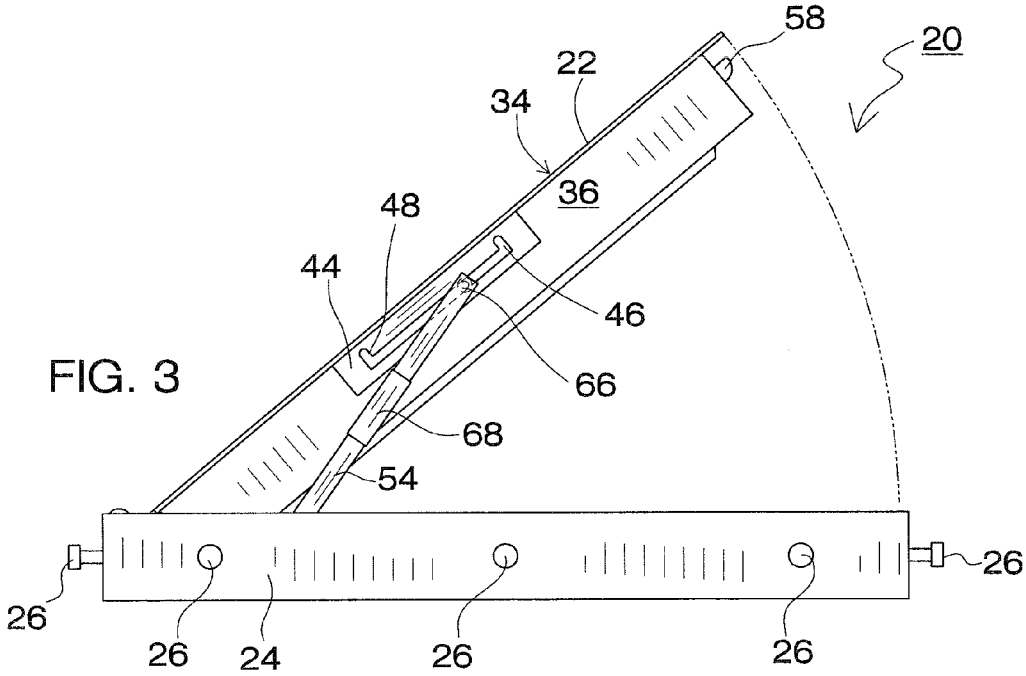
FIG. 3 is a side elevational view of the vault door being opened.
Figure 5:
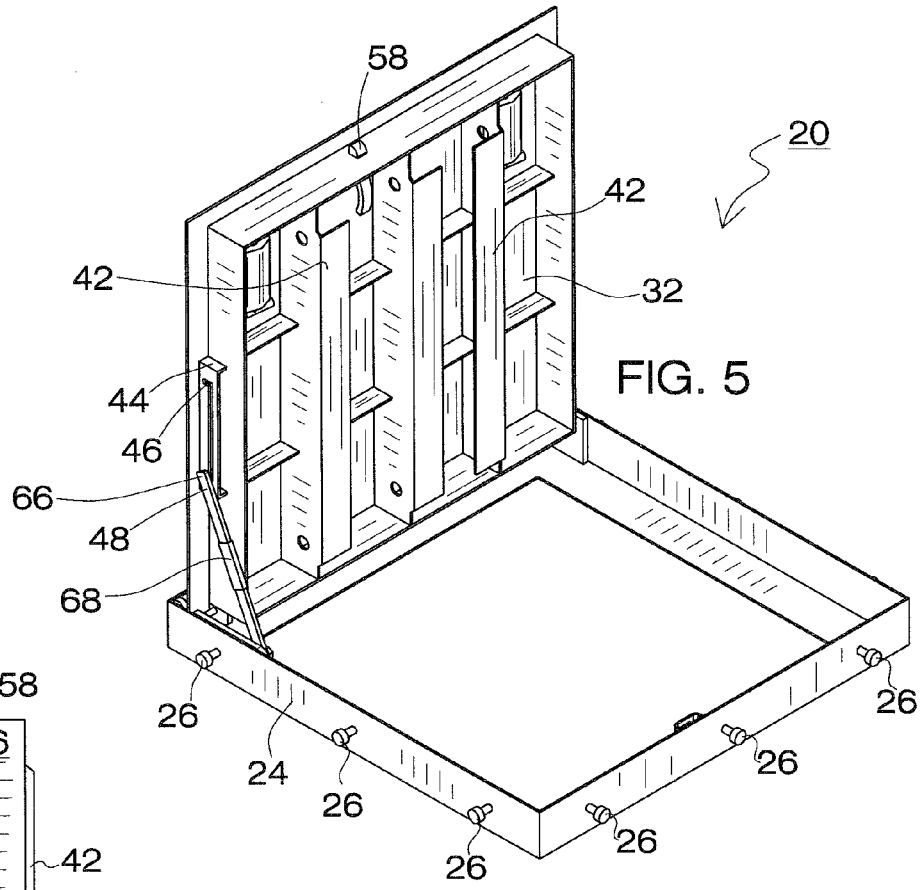
FIG. 5 is a perspective view of the vault door in the partially opened orientation.

With reference to FIGS. 3 and 5, the slide 44 associated with door 22 is depicted. As illustrated, slide 44 is centrally mounted upon one of the peripheral edges 36 of door 22. Slide 44 includes a detent 48 for locking door 22 in the 90° open position. An additional detent 46 is optionally included at the opposite end of slide 44. As described more fully hereinafter, slide 44 cooperates with a hold-open arm 54 to position door 22 between opened and closed positions.

Vault door 22 further including a pair of drop down lifting handles 56 positioned within the face of door 22. Handles 56 typically lie flush with the exterior face 34 of door 22 but can be raised in order to be grasped and used to pivot open door 22. Door 22 further includes a male detent 58 upon the forward peripheral edge 36. Male detent 58 cooperates with the associated female receiver 28 upon frame 24. In the preferred embodiment, detent 58 is a tamper resistant Pentahead bolt. The preferred mechanism is a slam lock with an inside release handle. Detent 58 automatically latches to receiver 28 when door 22 is closed. A locking key 62 can be used to thereafter unlatch door 22 for opening. In the preferred embodiment, locking key 62 has a pentahead female socket that engages the pentahead bolt 58.

Figure 6:
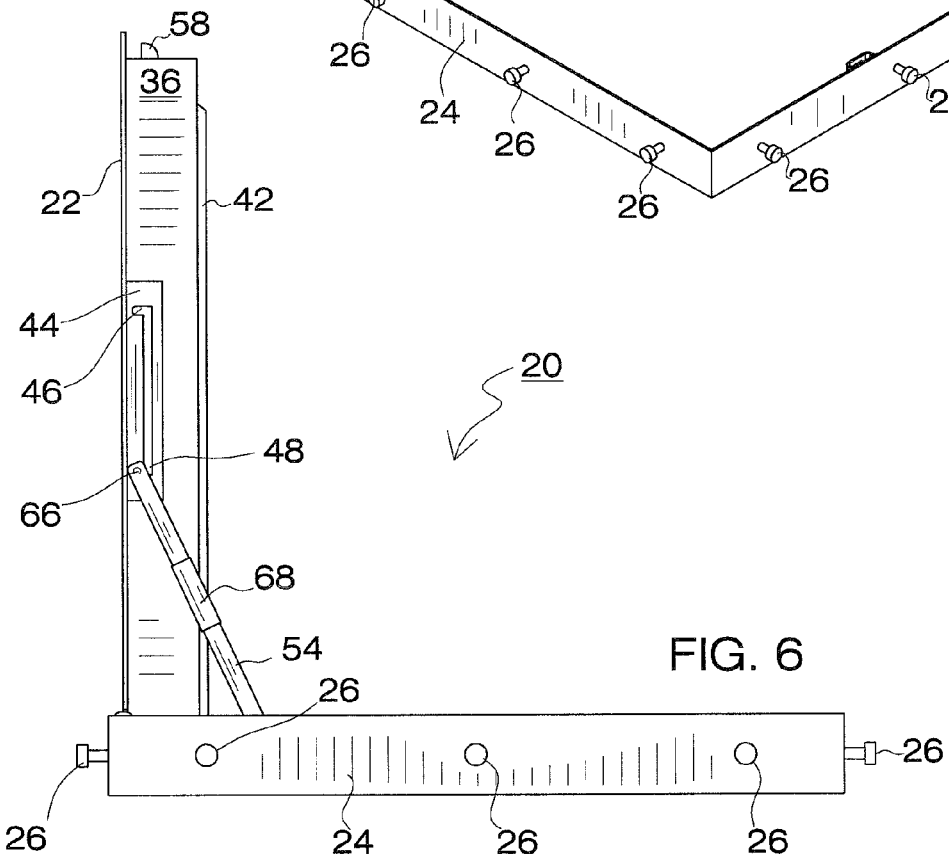
FIG. 6 is a side elevational view of the vault door in the partially opened orientation.

Door 22 can be retained in the partially opened position by way of hold-open arm 54. Hold-open arm 54 is preferably formed from a one piece construction. The arm 54 includes a first end 64 that is attached to hinge plate 72 via, for example, a threaded fastener. The second end 66 of arm 54 is slidably received within slide 44. A grip 68, which can be formed from vinyl or other similar soft material, is positioned along intermediate extent of arm 54. Thus, as illustrated in FIGS. 3 and 6, the second end 66 of arm 54 slides within track 44 between the first and second locking detents (46 and 48). As will be appreciated, when the second end 66 of arm 54 in the first detent 46, door 22 is in its closed position overlying the vault opening.

Figure 7:
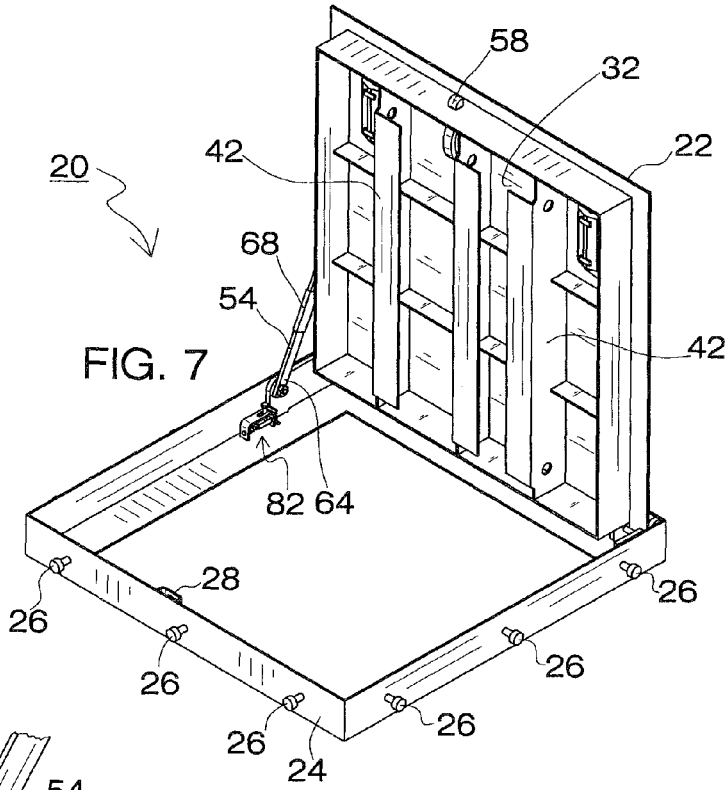
FIG. 7 is a perspective view of the vault door in the partially opened orientation.
Figure 10:
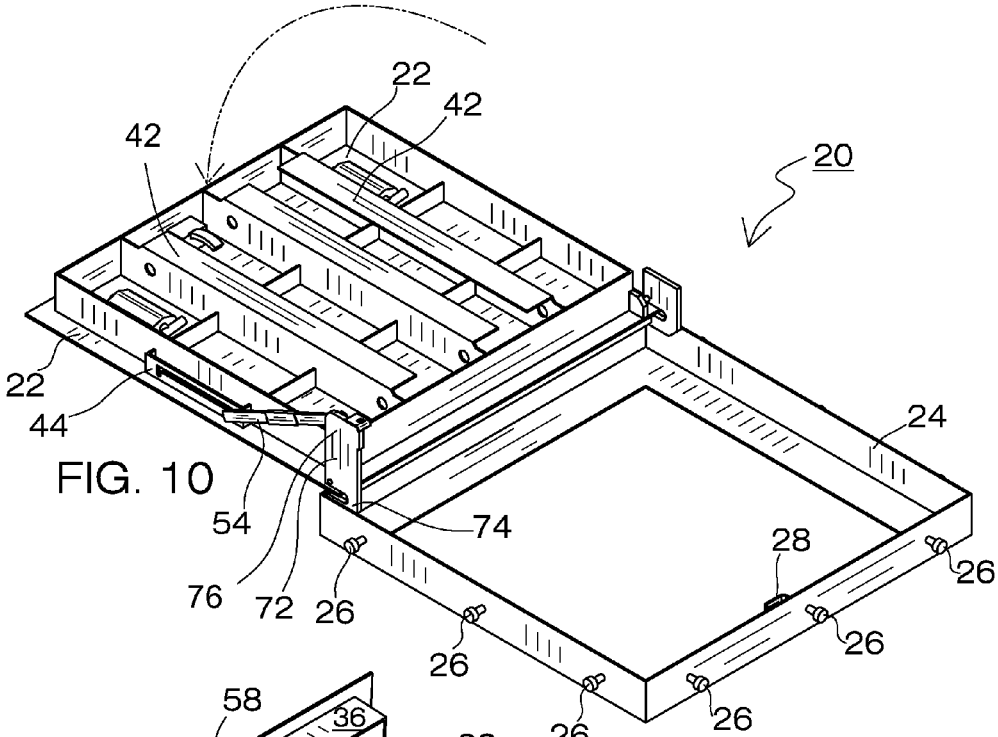
FIG. 10 is a perspective view of the vault door in the fully opened orientation.

The relationship between hinge plate 72 and hold-open arm 54 is most clearly illustrated in FIGS. 7 and 10. Here it can be seen that hinge plate 72 includes a first end 74 that is rotatably secured to frame 24. Thus, hinge plate 72 can pivot relative to frame 24 about end 74. The second end 76 of hinge plate 72 rotates freely but is secured to the first end 64 of hold-open arm 54. As illustrated, this connection can be achieved via a bolt or other threaded fastener. The second end 76 of hinge plate 72 also includes an apertured striker plate 78 to permit hinge plate 72 to cooperate with an associated locking mechanism 82 as more fully described hereinafter. Hinge plate 72 can thus be pivoted between a first orientation parallel to the frame 24 (FIG. 7) and a second orientation perpendicular to the frame 24 (FIG. 10). However, the use of a hinge plate 72 that pivots to other angular orientations is within the scope of the present invention. For instance, hinge plate 72 could rotate between positions that are other than the depicted parallel and perpendicular orientations.

Figure 11:
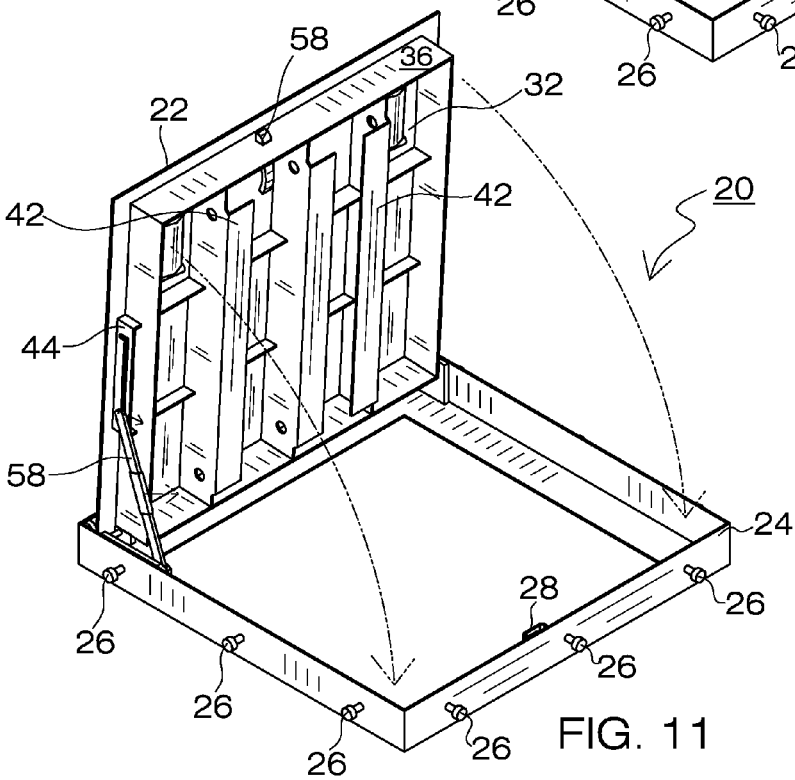
FIG. 11 is a perspective view of the vault door being closed.

Hinge plate 72 and hold-open arm 54 permit three door orientations. In the closed orientation, hinge plate 72 is in its first orientation and the second end 66 of hold-open arm 54 is positioned within the first detent 46 (FIG. 2). In the partially opened orientation (e.g. 90° opened), hinge plate 72 is in the first orientation and the second end 66 of hold-open arm 54 in the second detent 48 (FIG. 11). And finally, in the fully opened orientation (e.g. 180° opened), hinge plate 72 is in the second orientation and the second end 66 of hold-open arm 54 is in the second detent 48 (FIG. 10).

Figure 8:
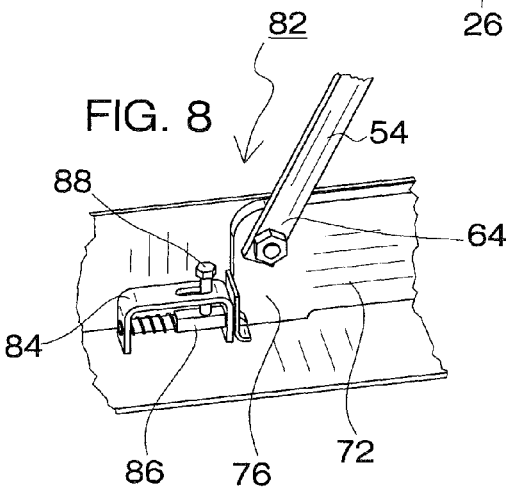
FIG. 8 is a detailed view of the locking mechanism and with the hinge plate locked.
Figure 9:
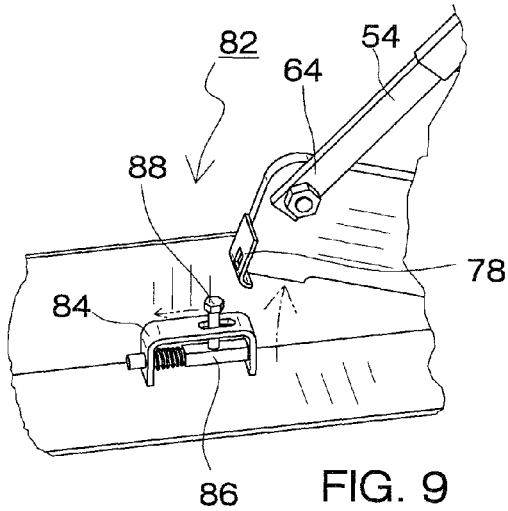
FIG. 9 is a detailed view of the locking mechanism and with the hinge plate unlocked.

The locking mechanism 82 is described next in connection with FIGS. 8 and 9. As illustrated, the locking mechanism 82 is positioned within inner peripheral extent of frame 24 adjacent hinge plate 72. The locking mechanism 82 includes an outer bracket 84. A spring biased locking pin 86 is positioned within bracket 84 and can be triggered by an associated upstanding locking bolt 88. The locking pin 86 is selectively secured within the aperture of striker plate 78 to thereby lock hinge plate 72 in the first orientation. Thereafter, a user can pull the locking bolt 88 to overcome the spring bias of locking pin 86 and thereby release hinge plate 72. With the locking pin 86 removed from striker plate 78, hinge plate 72 is free to pivot from the first to the second orientation.

Thus, the locking mechanism 82 locks door 22 in the partially opened position prior to it being fully closed or fully opened. This, in turn, prevents loss of control when a user is taking door 22 from the closed to the fully opened positions or vice versa.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A ground mounted vault closure selectively positionable between closed, partially opened, and fully opened orientations, the closure comprising:

a rectangular frame having inner and outer peripheral extents, a series of anchor studs positioned upon the outer peripheral extent, a female receiver formed within the frame, the frame being mounted into the ground and defining an access opening for an underground vault;

a vault door having interior and exterior surfaces and peripheral edges, the interior surface including reinforcing ribs, a slide with opposing first and second locking detents secured to one of the peripheral edges, the vault door further including a pair of lifting handles and a male detent, the vault door being pivotally connected to the frame and having a closed orientation overlying the rectangular frame and wherein the male detent is receivable within the female receiver to lock the door and deter access to the underground vault, the angle between vault door and the frame being approximately 90 degrees in the partially opened orientation, and the angle between the vault door and the frame being approximately 180 degrees in the fully opened orientation;

a one piece hold-open arm having first and second ends and an intermediate extent therebetween, a vinyl grip secured to the intermediate extent, the second end of the arm being slidably received within the slide and being selectively positionable between the first and second locking detents;

a hinge plate having a first end rotatably secured to the frame and a second end that is secured to the first end of the hold-open arm, a striker plate with an aperture secured to the second end of the hinge plate, the hinge plate pivoting between a first orientation parallel to the frame and a second orientation perpendicular to the frame, wherein the door is in the closed orientation with the hinge plate in the first orientation and the second end of the hold-open arm in the first detent, and wherein the door is in the partially opened orientation with the hinge plate in the first orientation and the second end of the hold-open arm in the second detent, and wherein the door is in the fully opened orientation with the hinge plate in the second orientation and the second end of the hold-open arm in the second detent;

a locking mechanism positioned within inner peripheral extent of the frame and adjacent the hinge plate, the locking mechanism including an outer bracket, the outer bracket housing a spring biased locking pin and an upstanding locking bolt, whereby the locking pin can be selectively secured within the aperture of the striker plate to thereby lock the hinge plate in the first orientation, and wherein the locking bolt can be used to overcome the spring bias of the locking pin to thereby release the hinge plate and permit rotation of the hinge plate from the first to the second orientation.

2. A ground mounted vault closure comprising:

a frame defining an access opening for an underground vault;

a vault door having interior and exterior surfaces and a number of peripheral edges, a slide with opposing first and second locking detents secured to one of the peripheral edges, the vault door being pivotally connected to the frame and having a closed orientation overlying the frame, the vault door having partially opened orientation wherein the angle between vault door and the frame is approximately 90 degrees, the vault door also having a fully opened orientation wherein the angle between the vault door and the frame is approximately 180 degrees;

a hold-open arm having first and second ends and an intermediate extent therebetween, the second end of the arm being slidably received within the slide and being selectively positionable between the first and second locking detents;

a hinge plate having a first end rotatably secured to the frame and a second end that is secured to the first end of the hold-open arm, the hinge plate pivoting between a first and second orientations, wherein the door is in the closed orientation with the hinge plate in the first orientation and the second end of the hold-open arm in the first detent, and wherein the door is in the partially opened orientation with the hinge plate in the first orientation and the second end of the hold-open arm in the second detent, and wherein the door is in the fully opened orientation with the hinge plate in the second orientation and the second end of the hold-open arm in the second detent.

3. The closure as described in claim 2 further comprising:

a striker plate with an aperture secured to the second end of the hinge plate; and a locking mechanism positioned adjacent the hinge plate, the locking mechanism including an outer bracket, the outer bracket housing a spring biased locking pin and an upstanding locking bolt, whereby the locking pin can be selectively secured within the aperture of the striker plate to thereby lock the hinge plate in the first orientation, and wherein the locking bolt can be used to overcome the spring bias of the locking pin to thereby release the hinge plate and permit rotation of the hinge plate from the first to the second orientation.

4. The closure as described in claim 2 wherein the hold-open arm is of a one piece construction and further includes a grip along its length.

5. The closure as described in claim 2 wherein the vault door further comprises a pair of lifting handles that are slidably received within the face of the door.

6. The closure as described in claim 2 wherein the door is constructed from a lightweight aluminum and the frame is constructed from steel.

7. A ground mounted vault closure mounted within a frame, the vault closure comprising:

a vault door having interior and exterior surfaces, a track secured to the door, the track having first and second locations, the vault door having partially opened orientation wherein the angle between vault door and the frame is approximately 90 degrees, the vault door also having a fully opened orientation wherein the angle between the vault door and the frame is approximately 180 degrees;

a hold-open arm having first and second ends, the second end of the arm being slidably received within the track;

a hinge plate having a first end secured to the door and a second end that is secured to the first end of the hold-open arm, the hinge plate pivoting between a first and second orientations, wherein the door is in the closed orientation with the hinge plate in the first orientation and the second end of the hold-open arm in the first location, and wherein the door is in the partially opened orientation with the hinge plate in the first orientation and the second end of the hold-open arm in the second location, and wherein the door is in the fully opened orientation with the hinge plate in the second orientation and the second end of the hold-open arm in the second location.

* * * * *